United States Patent [19]

Hanson

[11] 4,184,605

[45] Jan. 22, 1980

[54] CONTAINER OPENING MEANS

[76] Inventor: Paul T. Hanson, 244 Main St., Millbury, Mass. 01527

[21] Appl. No.: 953,014

[22] Filed: Oct. 20, 1978

[51] Int. Cl.[2] ..... B65D 41/32

[52] U.S. Cl. ..... 220/269; 220/270

[58] Field of Search ..... 220/266–274; 215/250, 253, 254; 222/541; 229/7 R

[56] References Cited

U.S. PATENT DOCUMENTS

| | | | |
|---|---|---|---|
| 3,404,800 | 10/1968 | Arfert | 220/269 |
| 3,422,984 | 1/1969 | Foster | 220/269 |
| 3,701,454 | 10/1972 | Thorp | 220/270 |
| 3,717,279 | 2/1973 | Patarini et al. | 220/269 |
| 3,923,193 | 12/1975 | Wells et al. | 220/269 |

*Primary Examiner*—George T. Hall

*Attorney, Agent, or Firm*—Norman S. Blodgett; Gerry A. Blodgett

[57] ABSTRACT

Container having a top wall formed of sheet material in which an opening for the removal of the contents is formed by pulling on a tab.

5 Claims, 6 Drawing Figures

CONTAINER OPENING MEANS

BACKGROUND OF THE INVENTION

It has become common practice to package potable liquids, such as soft drinks and beer, in sheet metal cans constructed so that access to the contents takes place through an aperture torn from one end wall. The tearing is accomplished by pulling on a tab which is connected to the material to be removed, the connection usually consisting of a solded or cemented connection or of a rivet. The tab and the removed area remain together this operation and the assemblage is either thrown away or inserted through the aperture into the interior of the can. Throwing away the tab is not only an insult to the environment, but can be downright dangerous, since it involves sharp-edged pieces of metal that can be stepped on by bare feet. Insertion of the tap into the interior of the can in a loose manner not only can inhibit proper flow of the liquid but can, under certain circumstances, the tab can be swallowed. Another difficulty experienced with the prior art devices has to do with attempts to pour the contents; because the aperture is always located a substantial distance away from the side wall, there is always present a "lip" which interferes with pouring and causes the contents to flow outwardly in an erratic manner. Furthermore, there is no way in which the can can be deformed to compensate for this difficulty. These and other deficiences with the prior art device have been obviated in a novel manner by the present invention.

It is, therefore, an outstanding object of the invention to provide a container including self-contained opening apparatus that is not removable from the container.

Another object of this invention is the provision of a sheet metal drink can having an opening apparatus that can be inserted into the interior without danger to the user.

A further object of the present invention is the provision of a container having a sheet metal end that can be opened in such a way as to provide a pouring spout.

It is another object of the instant invention to provide a can for liquids which is opened by tearing an aperture in one end and in which pouring takes place in a smooth manner.

A still further object of the instant invention is to provide a container having a tear-opening feature which is simple in construction, which is inexpensive to use in connection with existing type containers, and which is not damaged by shipping or long storage.

It is a further object of the invention to provide a sheet metal container which can be opened by tearing and in which no loose pieces are formed that can be used to desecrate the environment or to cause a potential danger to the user or other persons.

With these and other objects in view, as will be apparent to those skilled in the art, the invention resides in the combination of parts set forth in the specification and covered by the claims appended hereto.

SUMMARY OF THE INVENTION

In general, the present invention consists of a container having a main body formed of sheet material, the body having a tubular side wall and a bottom wall closing one end of the side wall. A top element formed of sheet material is formed with a top wall for closing the end of the side wall opposite the bottom wall and with a skirt extending along the outer surface of the side wall.

The skirt is provided with a pair of score lines defining a tab. The top wall is provided with a pair of score lines constituting extensions of the tab score lines, so that an application of force to the tab causes tearing to take place along all sets of score lines.

More specifically, the tab folds under the portion of the top wall between the score lines, so that the resultant folded portion and tab can be pushed downwardly into the interior of the can. The score lines define a trapezoidal figure, wherein the small end is at the tab and the large end is on the top wall. The skirt has a lower edge provided with upwardly-directed notches that lie on either side of the tab and lead into the score lines to assist in tearing the tab upwardly.

BRIEF DESCRIPTION OF THE DRAWINGS

The character of the invention, however, may be best understood by references to one of its structural forms, as illustrated by the accompanying drawings, in which.

DESCRIPTION OF THE PREFERRED EMBODIMENT

Figure 1:
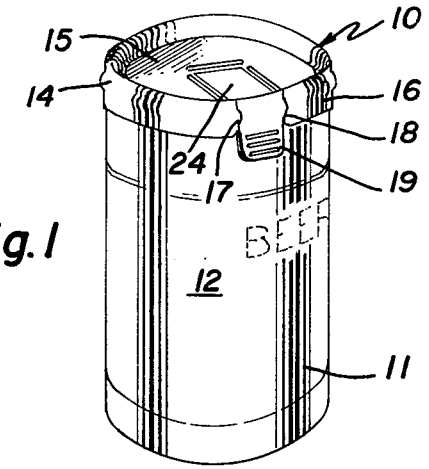
FIG. 1 is a perspective view of the container embodying the principles of the present invention.

Referring first to FIG. 1, wherein are best shown the general features of the invention, the container, indicated generally by the reference numeral 10, is shown as consisting of a main body 11 and a top element 14 both formed of a sheet material such as aluminum. The main body consists of a tubular side wall 12 and a bottom wall 13 which closes the lower end of the side wall to form a cup-like structure. The top element 14 consists of a top wall 15 which extends across and closes the other end of the side wall 12 and of a skirt 16 extending along the outer surface of the side wall. The skirt 16 is provided with spaced weakened score lines 17 and 18 which define a tear tab 19.

Figure 2:
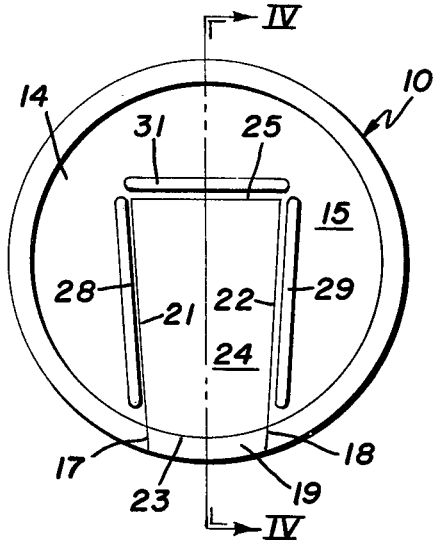
FIG. 2 is a top plan view of the container.
Figure 3:
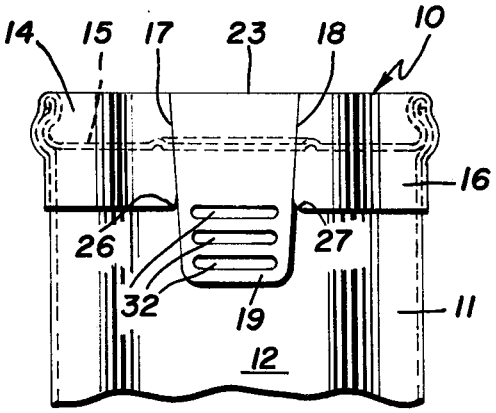
FIG. 3 is a front elevational view of the container with a portion broken away.

Referring next to FIGS. 2 and 3, which show further details of the invention, it can be seen that the top wall 15 is provided with weakened second score lines 21 and 22 which generally constitute extensions of the first score lines 17 and 18 which serves to define a portion 24 in the top wall. A transverse weakened bend line 23 lies between the first score line 17 and 18 on the one hand and the second score line 21 and 22 on the other hand. A transverse weakened score line 25 extends between the ends of the second score lines that are furthest from the first score lines. The first score lines 17 and 18 and the score lines 21 and 22 define a trapezoidal figure whose small end is at the tab 19 and whose large end is at the score line 25. The skirt 16 has a lower edge provided with upperwardly-directed notches 26 and 27 that lead into the first score line 17 and 18 to assist in tearing the tab 19 upwardly. The corrugation 28 extends along the score line 21 outside of the portion 24 and a similar corrugation 29 extends along the score line 22, while a corrugation 31 extends along the score line 25. A plurality of raised ridges 32 extend transversely across the tab 19 at its lower end to assist in grasping it.

Figure 4:
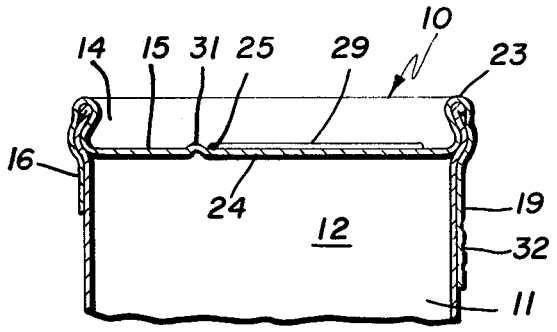
FIG. 4 is a vertical sectional view of the container taken on the line IV—IV of FIG. 2, and FIGS. 5 and 6 are vertical sectional views of the container showing the opening procedure.
Figure 5:
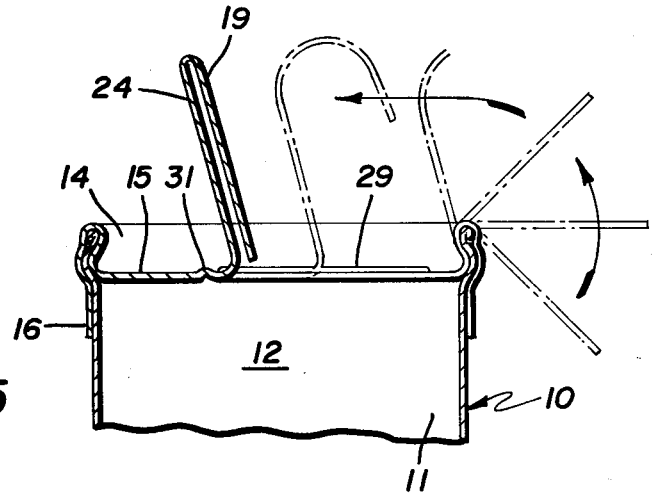
Figure 6:
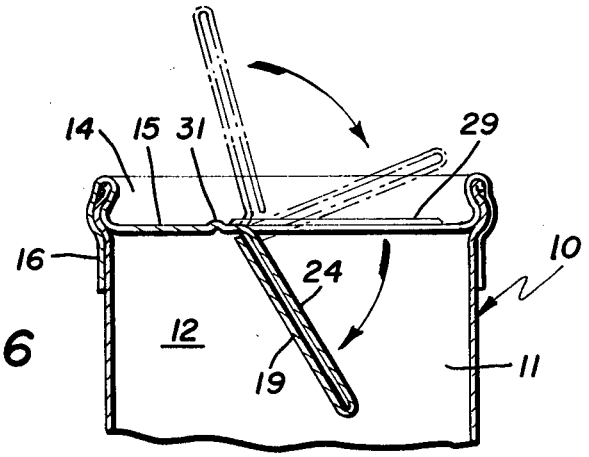

The operation and the advantages of the present invention will be clearly understood in view of the above description. FIGS. 4, 5, and 6 show three stages of the operation of the device. FIG. 4, of course, shows the container 10 as it exists with its contents, usually in the form of a liquid. The top element 14 is firmly formed during assembly around the upper edge of the main body 11, so that the top wall 15 is located downwardly from the upper end. This provides an excellent seal and a recess to assure that the top element is not readily removed from the main body before use of the contents. The container is capable of a considerable amount of abuse without the seal being opened. In order to open the can for access to the contents, the tab 19 is grasped and lifted upwardly, making use of the gripping ridges 32. The upward movement of the tab causes a tear to begin at the notches 26 and 27 and further upward movement carries the tear along the score line 17 and 18 over the top of the edge of the main body 11 of the container and into the score lines 21 and 22. As shown in FIG. 5, the tab is bent under the portion 24 and then, as is evident in FIG. 6, the former counter-clockwise motion is reversed to a clockwise motion and then folded tab 19 and portion 24 are pushed downwardly into the interior of the container. When this has been accomplished, an oening in the container exists which has a generally -trapezoidal shape defined by the portion 24. In addition, the entire portion of the top element 14 which formerly embraced the top edge of the side wall 12 has been removed, so that the edge of the side wall stands free and there is no portion of the top wall 15 to interfere with pouring of the liquid contents. A slight sidewise "pinching" pressure on the side wall produces a fold in the portion of the upper edge of the side wall thus formed to act as a spout and the edge of the side wall is no longer supported by the top element 14. The top element and portions associated with the tab 19 are formed integrally from a single sheet of sheet metal and can be assembled with the main body 11 at the time that the liquid is placed in the container. In this way, there is no separate riveted or welded element that can pull free of the top wall to leave the user with no method of opening the can except by some crude means. The fact that a portion of the upper edge of the side wall is exposed means that there are no flanges or impediments to prevent a smooth pouring of the liquid. As has been stated, a slight deformation of the container in the vicinity of the opening will cause the upper edge to deform and provide a pouring spout.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Container comprising:

(a) a main body formed of sheet material, the body having a tubular side wall and a bottom wall closing one end of the side wall, (b) a top element formed of sheet material, the element having a top wall closing the end of the side wall opposite the bottom wall and having a skirt extending along the outer surface of the side wall, the skirt being provided with weakened first score lines defining a tear tab, the top wall being provided with weakened second score lines constituting extensions of the first score lines, so that application of force to the tab causes tearing along the first score lines followed by tearing along the second score lines to form an opening in said top wall, said top element having a transverse weakened bend line between the first and second score lines and a transverse weakened score line extending between the ends of the second score lines that are furthest from the first score lines, so that the portion of the top element between said first and second score lines can be folded about said weakened bend line and bent about said transverse weakened score line under the general plane of the top wall to be completely free of said opening.

2. Container as recited in claim 1, wherein the first and second score lines define a trapezoidal figure whose small end is at the tab and whose large end is at the last-named score line.

3. Container as recited in claim 2, wherein the skirt has a lower edge provided with upwardly-directed notches that lead into the first score lines and assist in tearing the tab upwardly.

4. Container as recited in claim 3, wherein an embossed strengthening corrugation extends along each of the second score lines and the last-named transverse score line outside of the said portion of the top wall between the second score lines.

5. Container as recited in claim 4, wherein a plurality of raised ridges extend transversely across the tab.

* * * * *